United States Patent [19]

Fawcett

[11] 3,998,431

[45] Dec. 21, 1976

[54] WINCH

[75] Inventor: Derek James Fawcett, Rowlands Castle, England

[73] Assignee: Lewmar Marine Limited, Havant, England

[22] Filed: Apr. 29, 1975

[21] Appl. No.: 572,666

[30] Foreign Application Priority Data

May 10, 1974 United Kingdom ..... 20678/74

[52] U.S. Cl. ..... 254/150 R; 74/411.5

[51] Int. Cl.[2] ..... B66D 1/30

[58] Field of Search .... 254/150 R, 186 R, 186 HC, 254/170; 74/411.5; 192/47

[56] References Cited

UNITED STATES PATENTS

| | | | |
|---|---|---|---|
| 2,884,800 | 5/1959 | Carroll | 254/170 |
| 2,988,186 | 6/1961 | Dotter | 192/47 |
| 3,145,974 | 8/1964 | Short | 254/150 R |
| 3,541,888 | 11/1970 | Hegar et al. | 254/170 X |
| 3,711,065 | 1/1973 | Lawrence | 254/150 R |

FOREIGN PATENTS OR APPLICATIONS

| | | | |
|---|---|---|---|
| 200,771 | 7/1923 | United Kingdom | 254/170 |

*Primary Examiner*—Robert J. Spar
*Assistant Examiner*—Donald W. Underwood
*Attorney, Agent, or Firm*—Bacon & Thomas

[57] ABSTRACT

A winch has a plurality of forward drives and a reverse to its drum, all engageable from a single drive input. Respective drives are engaged by reversal of the direction of rotation of the drive input. Upon one such reversal, therefore, the reverse is automatically engaged. A preselector is provided to permit, after actuation of the preselector, the drives and the reverse to be automatically engaged in succession by successive reversals of the drive input. Locking of the drum against unwanted run back upon cessation of drive input is assured by a lost motion drive and unidirectional drive means in the reverse.

8 Claims, 9 Drawing Figures

WINCH

FIELD OF THE INVENTION

This invention relates to hand powered winches used in sailing craft.

BACKGROUND OF THE INVENTION

It is often desired to adjust the setting or tension of the sheet secured on the winch by winding off some of the sheet. Since these sheets are under very considerable tension it is not adequate simply to release the winch and there must be some form of control of the run back. The winch works uni-directionally under usual winding, and usually it is impossible to reverse or allow reversal of the direction of rotation of the winch simply by reversing the direction of winding of the input drive.

Previous proposals for providing for controlled run back have always involved complex manually operated gear changes or releases, or manual overrides of the normal winding mechanism, the characteristic feature of all these being either that the normal input to the winch was not used and was replaced by a completely separate input or that the normal input was transferred to a completely different drive shaft system within the winch, the normal drive trains being completely disconnected.

SUMMARY OF THE INVENTION

The present invention attacks the problem of providing a satisfactory run back in a winch from a different direction, namely by utilising the normal input and the normal drive shaft of the winch to affect the behaviour of a run back drive train driven from that shaft, and making the engagement of the run back drive automatic upon a reversal of the drive input.

In particular the invention provides a winch in which reversal of the direction of drive and input shaft will, when one speed of the winch is selected, permit run back of the drum of the winch whereas, when other speed ratios between the input shaft and the drum are selected, reversal of the drive shaft will merely cause selection of a different speed ratio between the drive shaft and the drum with the drum continuing to rotate in the same sense of rotation.

In one embodiment of the present invention a winch with three forward drive ratios is provided additionally with a further ratio engageable automatically by reversal of the input shaft after the third speed ratio has been engaged.

DESCRIPTION OF THE DRAWINGS

In the accompanying drawings

FIG. 6 is a radial section taken as a plane at right angles to that in which FIG. 1 is drawn.

DESCRIPTION OF A PREFERRED EMBODIMENT

Figures 1, 8:
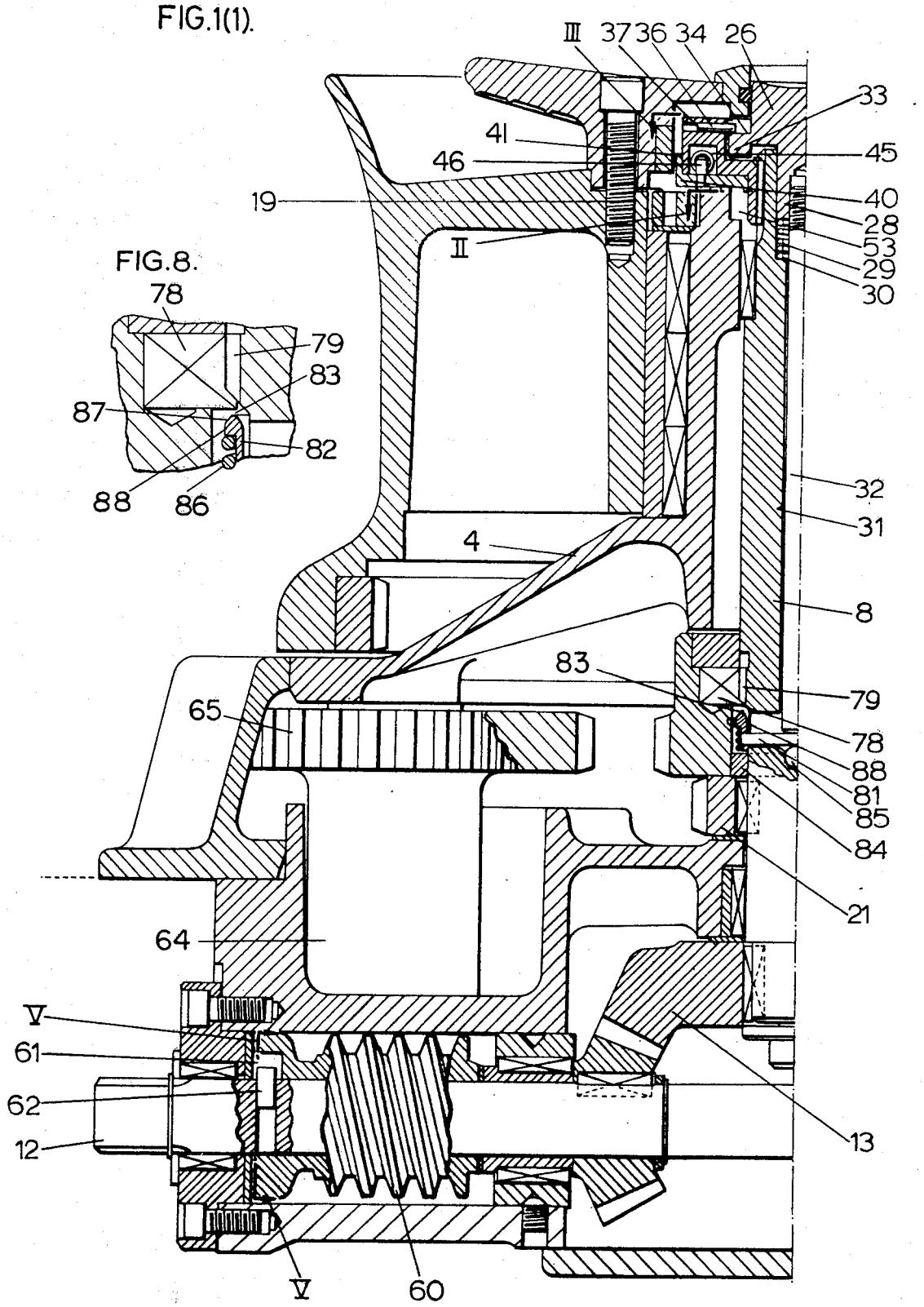
FIGS. 1(1) and 1(2) together are a section on two radii, on the lines I—I, FIG. 3, through an embodiment of winch.
FIG. 7 is a plan view to illustrate the arrangement of the gear trains and FIG. 8 is a detail, on an enlarged scale, of a portion of FIG. 1.
Figure 1:
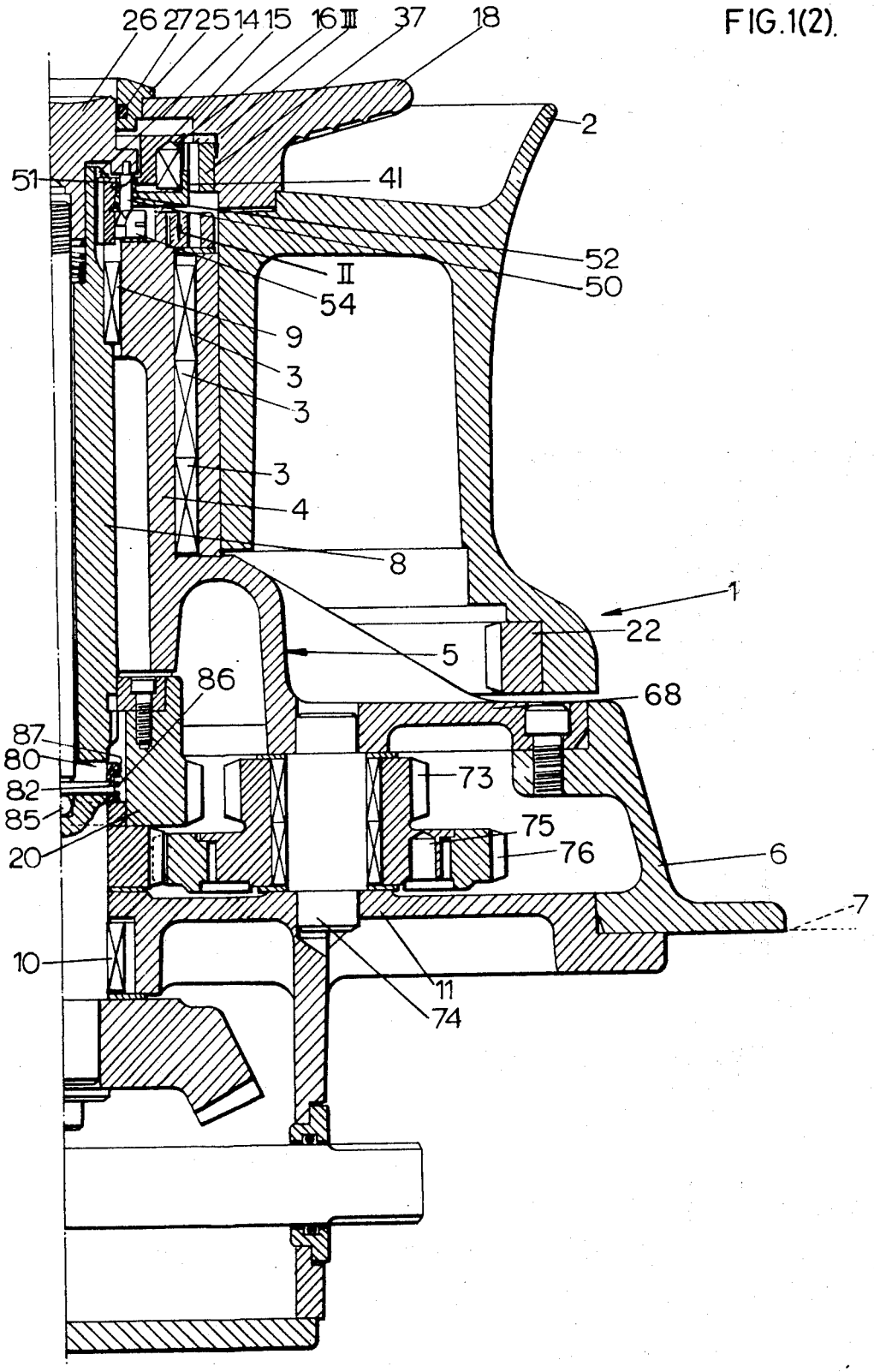

The winch 1 has a drum 2 mounted by means of rolling bearings 3 for rotation on a vertical axis about a cylindrical stem 4 of a domed casing 5 of which a base part 6 is mounted on a deck 7 of a sailing vessel. Within the stem 4 is a main drive shaft 8, mounted by rolling contact bearings 9 at the top of the stem and 10 in a floor plate 11 of the base portion 6 of the casing, so as to be able to rotate about a vertical axis coaxial with that of the drum. In this particular embodiment drive is brought in radially of that axis through an input drive shaft 12 whence it is taken via a crown gear pair 13 to the main drive shaft 8.

At the head of the main drive shaft 8 there is a splined portion 14 to which is fitted a splined sleeve 15 of a pawl ring 16 in which are mounted pawls 17 (FIG. 3) which are sprung loaded resiliently outwardly so that they are urged into engagement with ratchet teeth on a ratchet track 37 which is secured to a top cap 18 of the drum and which is in turn secured fast to the drum 2 by massive screws such as 19. Thus there is provided a path for the transmission of 1:1 drive from the main drive shaft 8 to the drum 2.

The embodiment shown provides three "forward" drive speed ratios between an input shaft 12 and a drum 2, one of which is the 1:1 drive between main drive shaft 8 and the drum, the second and third being respectively through pinions 20, 21 and associated drive trains to internal gearing 22 on the drum. These speeds are engaged in succession by successively rotating the drive shaft 8 in opposite senses of rotation, and there is an automatically operating actuator mechanism for distinguishing whether the 1:1 drive or the third speed ratio is to be engaged when the main shaft rotates in a given direction. This inventive mechanism is the subject of a pending U.S. Patent application Ser. No. 532,601 by the present inventor and filed on 13th December 1974. It will for completeness be more fully described hereunder, but it must be clearly realised that the present invention is concerned with the arrangements for automatically selecting either a forward speed or the winch run back drive by the direction in which the main input shaft 12 is rotated. This as can be seen is quite independent of the actuating mechanism at the upper end of the winch or indeed of the number of speed ratios which are provided in the winch. As will become apparent it is concerned only with changing between "forward" drive ratios and one "run back" drive, the features of which could be applied to any suitable type of winch with any suitable type of preselection or clutch disengagement mechanism as shown for example in my U.s. Pat. No. 3,802,665 or Application Ser. No. 413,254.

PRESELECTION OF 1:1 or THIRD SPEED RATIOS

Turning first to the 1:1 drive mechanism of the winch, at the centre of the top cap 18 there is an aperture in which is fitted a hollow plug 25 within which is axially and rotatably slidable a push button 26, sealed to the top cap by O-ring 27 to prevent ingress of water.

This button has a lower cylindrical portion 28 which is axially and rotationally slidable within a bore 29 in the head of the main drive shaft 8, it being spring loaded upwardly by spring 30 also received in that bore. Extending downwardly from the bore 29 is a narrow bore 31 which is for receiving a push rod 32 which is for influencing the coupling or uncoupling of the various gear drives, as will be described later.

A flange 33 of the push button fits radially within the pawl ring 16. It has a planar upper face 34 which is interrupted at its radially outer periphery by a pair of diametrically opposed slots 35 which are for the reception of radially inwardly projecting end portions 36 of pins 37 mounted in the pawl ring to lie in a plane normal to the axis of the winch. It can be seen therefore that when the slots 35 are brought into register with the projecting portions 36 of the pins the button will be free to move upwardly compared to the position which is shown in FIG. 1, where the pin portions 36 are engaging the generally planar upper surface 34 of the flange 33 of the button.

Figure 3:
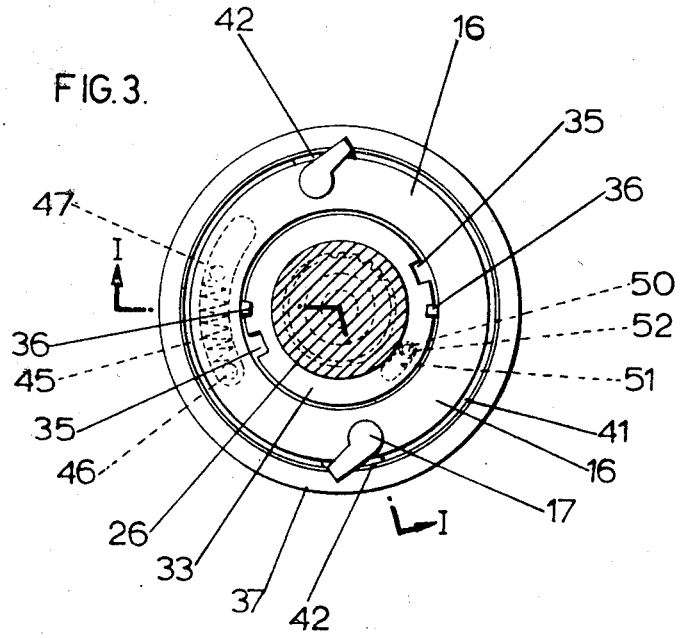
FIG. 3 is a section on the line III—III, FIG. 1.
Figure 4:
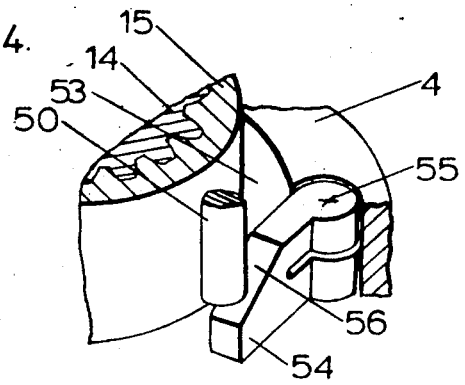
FIG. 4 is a sketch perspective view of a non-return catch.

An actuator for permitting engagement or causing disengagement between the pawls 17 and ratchet 37 consists of a ring 40 rotatably mounted about the sleeve portion 15 of the pawl ring 16 so as to underlie that ring and which has an upstanding cylindrical skirt portion 41 which surrounds the lower part of the outer periphery of the pawl ring 6. However the skirt 41 is interrupted at two diametrically opposed parts 42 (FIG. 3) large enough to permit the pawls to project outward, when those apertures are appropriately positioned. If however the apertures are moved by relative rotation of the ring 14 against the pawl ring 16 (this relative rotation would be clockwise as seen in FIG. 3) one edge of the skirt 41 defining one end of the aperture 42 comes up against the radially outer face of the respective pawl and pushes it inwards about its pivot axis so that it is held out of engagement with the teeth of the ratchet ring 37.

The ring 14 is however held biased towards an anti-clockwise direction of rotation relative to the ring 16 by means of a tension spring 45 extending between a post 46 fast with the ring 40 and a post 47 with the ring 16. So the tendancy of this spring is to restore the ring 40 to a position, relative to ring 16 in which the pawl 17 are free to fly outwardly. This end position is defined by the spring 45 becoming solid.

To cause the ring 40 to move to its cocked position in which the spring 45 is extended and the skirt 41 is moved so as to push the pawls inward, there is provided a uni-directional catch. This includes a pin 50 projecting downwardly from the flange 33 of the button 26 through an arcuately elongate slot 51 in the ring 16 and a close-fitting slot 52 in the ring 40 into a track 53 defined by a radially enlarged inner wall of the stem 4 of the casing. In one or more positions (in this embodiment only one is shown) there is provided a pawl 54 pivoted about a stationary axis 55 in the casing 4 and resiliently urged to project inwardly to the full line position shown in FIG. 2. When projecting inwardly its end face intercepts the locus of the pin 50 in the path 53 when the pin is in a downward position, as shown in FIG. 1, so that on rotation of the pin 50 in one direction about the axis of the winch it has to push the pawl out of the way against the resilient loading of its spring whereas in the other direction of rotation of the push button 26, with which the pin 50 is fast, the latter will strike the end face of the pawl 54. However this has, extending to below the level where the pin 50 reaches, an inclined face 56 which acts as a ramp so that as well as arresting rotation of the pin 50 in that direction it will also urge the pin 50 upwardly. It is to be remembered that the pawl 54 is pivoted on a stationary part and so it is not concerned with relative rotations of rotating parts but only with the absolute direction of rotation of the pin 50.

Rotation of the ring 40 is caused as will now be described, remembering that the pin 50 will carry the ring with it in rotation because of the engagement between it and the slot 52 in the ring 40.

To engage the direct 1:1 drive, which is the drive usually needed when starting operation of a winch since it is the one which offers least mechanical advantage to the operator, the operator depresses the push button 26. This brings the projecting pin portions 36 to above the level of the upper surface 34 of the flange 33 of the push button so that there is no detent acting between the flange 33 and pawl ring 16, the spring 45 is free to contract thus rotating the ring 40 relative to the ring 16 to bring the apertures 42 to the position shown in FIG. 3 so that the pawls 17 project. The limit of such rotation is in this embodiment governed by the pin 50 coming up against one end of the slot 51, but could be determined by the spring 45 becoming solid. After this rotation of the ring 40, when the shaft 8 is driven in the appropriate direction direct drive will be transmitted through those pawls to the drum.

Figure 2:
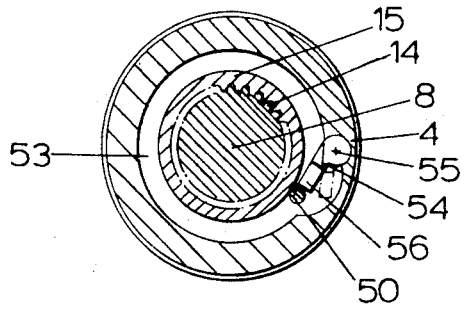
FIG. 2 is a section on the line II—II, FIG. 1.

The same depression of the button causes the pin 50 to project down as shown in FIG. 1 so that it will interfere with the pawl 54. As long as the rotation continues which represents transmission of direct drive through the unidirectional pawls 17 the pin 50 merely clicks past the pawl 54 i.e. the pin 50 is executing a clockwise orbit as is seen in FIG. 2.

To engage the next speed however the operator will reverse the direction of the input drive in the input shaft 12. This has the effect of course of reversing the direction of rotation of the shaft 8 and the drive is immediately taken up between that shaft and the drum by one of the gear train pinions 20, 21. However when the operator once again reverses his drive he will want to go not to the direct drive but to the third speed ratio which is available and the direct drive actuator arrangement which has been described performs this pre-selection automatically. The pin 50 is still in its lowered state as seen in FIG. 1. When the second drive ratio is engaged it is being carried round with the drive shaft 8 in now an anti-clockwise orbit as seen in FIG. 2. When the pin comes up against the pawl 54 the latter first arrests the rotation of the push-button 26 so that there is relative travel of the pin portions 36 over the faces 34 of the flange 33 of that button and at the same time there is extension of the spring 45. This continues until such time as the pin portions 36 arrive over the slots 35 when the ramp action of the end face 56 of the pawl positively urges the button 26 axially upwardly so that the pin portions 36 positively engage the slots 35. This cocking action of the spring 45 is due to the positive rotation of the pawl ring 16 which is splined positively to the portion 14 of the shaft 8, coupled with the retention of the ring 40 by the pin 50. At the same time this same upward movement of the button 26 as the pins 36 engage in the slots 35 raises the pin 50 until it is clear of the upper face of the pawl 54 and the whole assembly is then free to rotate with the shaft 8 in its new direction and with the pawl 17 held retracted by the skirt 41. When there is subsequent second reversal of the direction of rotation of the drive shaft 8 the pawls remain inactive and the third drive ratio of the winch becomes engaged unless, of course, the operator has intervened and once again depressed the button 26.

ENGAGEMENT OF THIRD SPEED RATIO OR OF RUN-BACK ON REVERSAL OF DRIVE

Figure 6:
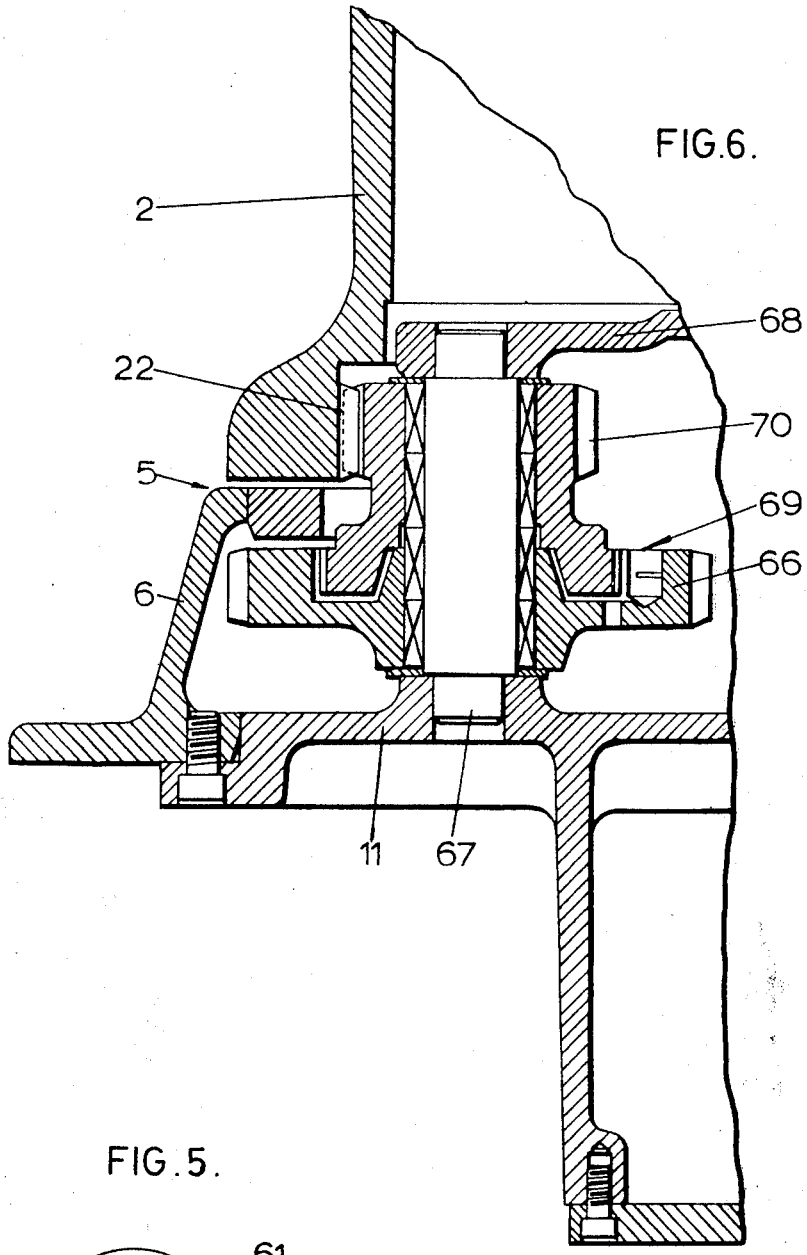
Figure 5:
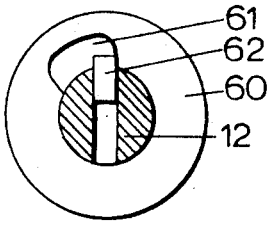
FIG. 5 is a section on the line V—V, FIG. 1.
Figure 7:
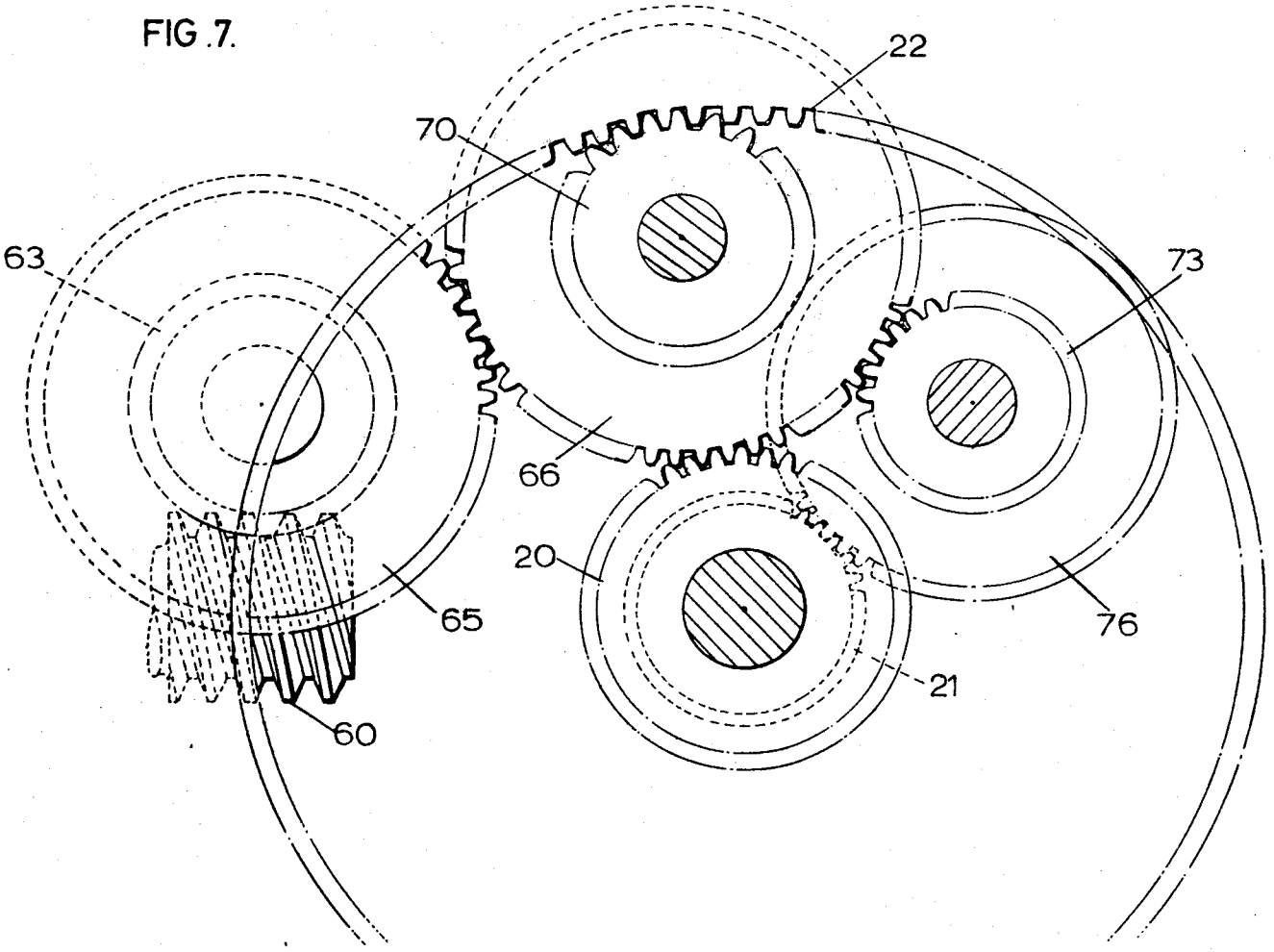

Drive from the input shaft 12 as well as going through the crown gear pair 13 to the main drive shaft 8 is transferable also to a worm 60 which is rotatably mounted about the shaft 12 but which is constrained to it by a lost motion linkage consisting of a slot 61 in one end face of the worm and a radially projecting pin 62 in the shaft 12. The dimensions of the slot and the pin are such that there is a 45° freedom of rotation between the worm and the shaft. The crown gears are of course completely securely splined to the shaft 12 and drive shaft 8 respectively. The worm 60 meshes with a worm gear 63 (FIG. 7) which drives, through a uni-directional drive (not shown) a column shaft 64 at the head of which is a large pinion 65. This meshes with pinion 66 (FIGS. 6 and 7) which is mounted on a shaft 67 borne on the casing for plate 11 and by the lower flanges 68 of the cylindrical stem 4 of the casing. This pinion 66 drives, again through a unidirectional drive, a final drive pinion 70 which meshes with the internal gear track 22 on the drum.

The pinion 66 meshes also with two other pinions. It meshes directly with pinion 20 which is borne on the main drive shaft 8 through a disengageable pawl arrangement 78 which will be described in more detail later and which is engageable with a ratchet track 79 formed in the main drive shaft 8. Pinion 66 also engages with a pinion 73 borne by a shaft 74 borne by the floor portion 8 and by the flange 68 of the casing and which in turn can be uni-directionally driven via a pawl and ratchet ring 75 by a pinion 76 which meshes with pinion 21 which is keyed at all times to rotate with the main drive shaft 8.

Let us consider first the input shaft 12 rotating in one direction with the third speed ratio (pinions 21, 76, 73, 66) driving the drum from the main drive shaft 8. At the same time rotation of the worm 60 and the influence of the pin 62 will be driving the worm gear 63. But the choice of ratios, both in the pinion gears and in the screw angle of the worm, is such that the wheel 65, which is permanently engaged with the pinion 66, is driven in the same direction as the worm wheel 63 but slightly faster than the latter so that it overtakes that wheel 65 and the uni-directional drive between them is ineffective. If it is a pawl and ratchet arrangement, the pawls merely click. If however the shaft 12 is reversed in direction of rotation then it is the uni-directional drive 75 which becomes ineffective, there is no drive from that source on the pinion 65 and therefore the uni-directional drive within the worm wheel 63 will take up drive and will cause the pinion 65 hence the pinion 66 to rotate in the opposite sense of rotation from that considered previously. This will not positively drive the winch drum back because there is at all times a uni-directional drive between the pinion 66 and the final drive gear 70. But the moving back of the pinion 66 would allow the winch drum to run back concomitantly. The absence of positive drive is not under operating conditions a handicap since this particular use occurs when the winch is working with a sheet wound round it and under considerable tension, amply sufficient to move the winch drum 2 back as the pinion 66 moves.

This mechanism also provides a lock for the drum 2 when the input shaft 12 is stopped. In many multi-speed drums such braking effect is provided by having uni-directional drives arranged so that they oppose each other and lock if the winch attempts to reverse against a stationary drive shaft. In this case however the braking effect is obtained by the irreversability of the drive between the worm 60 and its associated wheel 63. If the drive to the shaft 12 is stopped so that it is stationary and there is tension on the drum it will tend to try to drive back through the third speed ratio drive 66, 73, 76, 21 and the crown gears 13. There is nothing to stop this. However it will also try to drive back through the pinion 66, pinions 65 and worm wheels 63 onto the worm 60. Once the uni-directional drive within the wheel 63 has engaged, no further rotation of this system is possible without driven rotation of the shaft 12 because of the mechanical disadvantage between the worm gear 63 and the worm 60. Thus once that unidirectional drive in the wheel 63 is engaged the drum cannot run back further. On the other hand, as has been mentioned, the third speed ratio is tending also to drive the shaft 12 and, until the uni-directional drive within the wheel 63 is engaged, the shaft 12 is free to so rotate. Now if the worm 60 were secured rotationally fast to the shaft 12 at all times the effect would be that the engagement to be obtained within the worm wheel 63 would be chasing the rotation of the worm 60 and it might be some time before the desired lock was achieved since, as has been mentioned, the difference in drive ratios through the two routes is not large. Therefore the lost motion linkage 61, 62 is interposed between the worm and the shaft 12 so that when the shaft 12 is driven back through the third speed ratio drive the worm is not immediately driven back; it is arranged that the 45° movement of the worm represents 360° movement of the shaft 64 i.e. it is so arranged that the uni-directional drive device within the wheel 63 must engage before the driving back of the shaft 12 affects the worm 60, the pin 62 not then having yet reached the other end of the slot 61. In this way the run back of the winch drum under tension when drive is stopped, and without there being provided any special brakes or locks, is restricted at the very most to one rotation of the column shaft 64 which is a very small fraction of a single rotation of the drum.

That mechanism then is applicable to any multi-speed winch, but when applied to a multi-speed winch of the type shown there must additionally be means for disconnecting the second speed ratio from drive when the third speed ratio is engaged; otherwise the reverse rotation of the main input 12 would cause not run back of the winch drum but winding forward at the second speed ratio.

PRESELECTION OF EITHER SECOND SPEED RATIO OR RUN BACK

As has already been described the push rod 32 is secured to the button 26 and extends through the bore 31 in the middle of the main drive shaft 8. This goes as far as a diametrical, axially elongate, slot 80 in which there is positioned axially slidably, a cross pin 81 the ends of which are received in a sliding collar 82 the top end of which is formed as an annular, angled, ridge 83. A bearing collar 84 is pinned fast to the shaft 8 by a diametrical pin 85 and provides at the same time radial spacing of the pinion 20, axial location of the pinion 21 and on abutment against which there bears a spring 86 which resiliently urges the collar 82 upwardly.

The ridge 85, when the collar 82 is upward, is to interfere with the radially innermost ends of the pawl 78 to keep that pawl 78 free of the ratchet ring 79 on the main drive shaft 8. The radius of the ridge 83 is less than the radius of the apices of the ratchet teeth of the ring 79 but greater than the radius to which the innermost end of the pawl 78 reaches.

The action of this automatic disengaging mechanism is as follows. When the push-button 26 is depressed, apart from the actions which occur in the direct drive mechanism, the push rod 32 is also depressed downwardly and this bears on the cross pin 81 and carries the collar 82 downwardly also so that the ridge 83 is clear below the bottom of the pawl 78 (as shown in FIGS. 1 and 8). On rotation of the shaft 8 in one direction the 1:1 drive is engaged. On subsequent rotation in the opposite direction the second speed ratio is engaged this being through the pawl 78 pinion 20 and pinions 66 and 70 to the internal gearing 22. It will be recalled that as this drive becomes effective so the actuating mechanism at the head of the winch is cocked and amongst other events the button 26 rises upwardly as the projection portions 36 of the pins 37 engage the slots 35. This upward movement carries with it the push rod 32 so that its lowermost end is then about level with the upper end of the slot 80. The collar 82 tries to rise but since the pawl 78 is firmly engaged and is driven by the ratchet 79 its radially innermost end is inwardly of the ridge 83 and the ridge 83 merely bears against the lowermost surface of the pawl. However, when the shaft 8 is reversed again in rotation, the 1:1 drive having been disconnected automatically, drive will now be taken up, at the third speed ratio, by the pinion 21 through pinions 76, 73 and 66. This means that the pawl 78 will be clicking over the ratchet 79 and during some stages of this clicking its radially innermost end will come radially outside the ridge 83. Under the influence of the spring 86 the collar 82 can then rise further up and as it does so the innermost corner of the pawl rides down the frusto-conical sloping annular surface 87 of the collar so that the pawl is swung to a progressively more radially outer position until such time as a cylindrical outer surface 88 of the collar 82 is radially between the pawl 78 and the main drive shaft and the pawl is held completely and permanently disengaged from the ratchet track 79. Then, if there is reversal of the direction of rotation of input drive shaft 12 (and hence of the main drive shaft 8) for the purpose of engaging the run back the second speed ratio will not be engaged.

Depression of the push button 26 will remove the collar 82 from between the pawl 78 and track 79; if it is not so depressed further reversal of the direction of rotation of the input drive shaft 12 after run back has been engaged will cause re-engagement of the third drive ratio.

I claim:

1. A manually operated winch having a rotatable drum, a rotatable drive input and a plurality of trains operable between the drive input and the drum, a lesser plurality of said trains being connected to drive the drum forward in a given direction of rotation and in successively different drive ratios upon reversal of the drive input into successively different directions of rotation; one of the said trains being for running back of the drum upon a further reversal of the direction of rotation of the drive input, the said trains each incorporating unidirectional drive means whereby the respective trains are automatically rendered drive-transmissible upon rotation of the drive input in the respective one direction and its opposite, a preselector operable such that only one of the trains is drive-transmissible upon rotation of the drive input in one direction, the unidirectional drive means in the run back train comprising a worm and wheel drive, a lost motion drive being provided between the worm and the drive input, the said lost motion drive comprising means mounting the worm on a shaft constituting the drive input and permitting about 45° of free rotation between the worm and the shaft.

2. A manually operated winch as claimed in claim 1 wherein the said lesser plurality consists of three drive trains of successively greater mechanical advantage, the least mechanical advantage from the input to the drum being a 1:1 drive train.

3. A manually operated winch having a rotatable drum; a rotatable drive input and a plurality of trains operable between the drive input and the drum, a lesser plurality of said trains being connected to drive the drum forward in a given direction of rotation and in successively different drive ratios upon reversal of the drive input into successively different directions of rotation, one of the said trains being for running back of the drum upon a further reversal of the direction of rotation of the drive input, the said trains incorporating unidirectional drive means whereby the respective trains are automatically rendered drive-transmissible upon rotation of the drive input in the respective one direction and its opposite, a preselector operable such that only one of the trains is drive-transmissible upon rotation of the drive input in one direction, wherein the said lesser plurality consists of three drive trains, the said plurality consisting of four drive trains, two said trains being drive-transmissible upon rotation of the drive input in the one direction and the other two of said trains being drive-transmissible upon rotation of the drive input in the direction opposite to the one direction, the preselector isolating the said trains such that only one of the two said trains and only one out of the other two of the said trains are available at any one time for respective drive-transmission according to the direction of rotation of the drive input.

4. A manually operated winch as claimed in claim 3 including means automatically operating the preselector upon a first reversal of the direction of rotation of the drive input to ensure engagement of a third train upon a second reversal of the direction of rotation of the drive input and automatically operating the preselector upon the second reversal of the direction of rotation of the drive input to ensure engagement of a fourth train upon a third reversal of the direction of rotation of the drive input.

5. A manually operated winch as claimed in claim 4 wherein the fourth train is the run back train.

6. A manually operated winch as claimed in claim 3 wherein the unidirectional drive means in the run back train is a worm and wheel drive, a lost motion drive being provided between the worm and the drive input, the said lost motion drive comprising means mounting the worm on a shaft constituting the drive input and permitting about 45° of free rotation between the worm and the shaft.

7. A manually operated winch as claimed in claim 3 wherein the unidirectional drive means in the run back train is a worm and wheel drive, the worm of the worm and wheel drive being mounted on a sole drive input shaft, a first crown wheel of a crown gear pair mounted on the drive input shaft, the second crown wheel of the crown gear pair being mounted on a central drive spindle and meshing with the first crown wheel, the central drive spindle being coaxial with the drum and the drive input shaft being at right angle to the central drive spindle, the worm wheel being one portion of a double pinion, a second portion of the double pinion being meshed in one of the other said drive trains and means for preventing the worm and worm wheel being driven back together by drive from the drum through the said one of the other drive trains.

8. A manually operated winch as claimed in claim 7 wherein the said preventing means is the lost motion drive provided between the worm and the drive input.

* * * * *